United States Patent [19]

Shibata et al.

[11] Patent Number: 4,807,574

[45] Date of Patent: Feb. 28, 1989

[54] VALVE OPERATING DEVICE FOR INTERNAL COMBUSTION ENGINE

[75] Inventors: Mitsuhiro Shibata, Saitama; Kazuhide Kumagai, Tokyo; Koichi Fukuo, Saitama; Toshiaki Hiro, Saitama; Masahiko Matsumoto, Saitama, all of Japan

[73] Assignee: Honda Giken Kogyo Kabushiki Kaisha, Tokyo, Japan

[21] Appl. No.: 137,954

[22] Filed: Dec. 24, 1987

[30] Foreign Application Priority Data

Dec. 27, 1986 [JP] Japan ..... 61-311629
Dec. 27, 1986 [JP] Japan ..... 61-311630

[51] Int. Cl.[4] ..... F01L 1/18; F01L 1/26; F01M 9/10

[52] U.S. Cl. ..... 123/40.16; 123/90.17; 123/90.34; 123/90.36

[58] Field of Search ..... 123/90.16, 90.17, 90.27, 123/90.33, 90.34, 90.36, 90.39, 90.44, 198 F

[56] References Cited

U.S. PATENT DOCUMENTS 3,628,513 12/1971 Grosseau ..... 123/90.34
3,782,357 1/1974 Kuhn et al. ..... 123/90.33 X
4,441,465 4/1984 Nakamura ..... 123/90.33 X
4,535,732 8/1985 Nakano et al. ..... 123/90.16
4,537,165 8/1985 Honda et al. ..... 123/90.16
4,545,342 10/1985 Nakano et al. ..... 123/198 F
4,656,977 4/1987 Nagahiro et al. ..... 123/90.16
4,709,667 12/1987 Ichihara et al. ..... 123/90.34

*Primary Examiner*—Willis R. Wolfe
*Attorney, Agent, or Firm*—Lyon & Lyon

[57] ABSTRACT

A valve operating mechanism for an internal combustion engine has a low-speed cam for operating the intake or exhaust valves during low-speed operation of the engine and a high-speed cam for operating the intake or exhaust valves during high-speed operation of the engine. A low-speed lubricating oil passage is provided for supplying lubricating oil to the low-speed cam and a separate high-speed lubricating oil passage is provided for supplying lubricating oil to the high-speed cam. A control valve is connected to said low-speed and high-speed lubricating oil passages for selectively supplying maximum oil pressure to the high-speed lubricating oil passage during high-speed operation while restricting the rate of flow of oil during low-speed operation of the engine and supplying maximum oil pressure to the low-speed lubricating oil passage during low-speed operation of the engine while restricting or eliminating the oil supplied thereto during high-speed operation.

7 Claims, 3 Drawing Sheets

VALVE OPERATING DEVICE FOR INTERNAL COMBUSTION ENGINE

The present invention relates to a valve operating mechanism for an internal combustion engine having intake or exhaust valves selectively operable by different cams for high-speed or low-speed operation of the engine to improve performance and, in particular, to the hydraulic system for controlling the selective operation.

Heretofore, valve operating devices of this general type have been known, for example, as disclosed in U.S. Pat Nos. 4,537,164, 4,537,165, 4,545,342, 4,535,732, 4,656,977, 4,612,884, 4,576,128 and 4,587,936 owned by the assignee of this application.

In a valve operating mechanism, lubricating oil is supplied to the mutually sliding surfaces of cams and cam followers to lubricate these sliding surfaces. According to the conventional arrangement, the lubricating oil is supplied equally to the sliding surfaces. The sliding surfaces of low-speed cams and cam followers remain in sliding contact but are subjected to a relatively small load during sliding movement when the engine operates in a high-speed range since the low-speed cams and cam followers are not being used to open the valve. Similarly, the sliding surfaces of high-speed cams and cam followers remain in sliding contact but are subjected to a relatively small load during sliding movement when the engine operates in a low-speed range. Therefore, by controlling the rate of flow of lubricating oil to be supplied to these sliding surfaces dependent on the operating conditions of the engine, the sliding surfaces can be adequately lubricated with a relatively small amount of lubricating oil, whereby the oil pressure supply source such as an oil pump may be reduced in size and the amount of energy consumed to drive the oil pressure supply source will be reduced.

It is an object of the present invention to provide a valve operating mechanism for an internal combustion engine wherein a minimum amount required of lubricating oil is suggested to the mutually sliding surfaces of cams and cam followers dependent on the operating conditions of the engine thereby permitting the use of a smaller size of oil pressure supply source and reducing the amount of energy consumed to drive the oil pressure supply source.

According to the present invention, a valve operating mechanism includes a low-speed lubricating oil passage for supplying lubricating oil to sliding surfaces of the low-speed cam and the associated cam follower, a high-speed lubricating oil passage for supplying lubricating oil to sliding surfaces of the high-speed cam and the associate cam follower, which low-speed lubricating oil passage and high-speed lubricating oil passage supply are independent of each other, an oil pressure source, and a control valve connected between the low-speed lubricating oil passage, the high-speed lubricating oil passage, and the oil pressure supply source for selective communication among the passages and the supply source.

An embodiment of the present invention will hereinafter be described with reference to the drawings, wherein.

Figure 1:
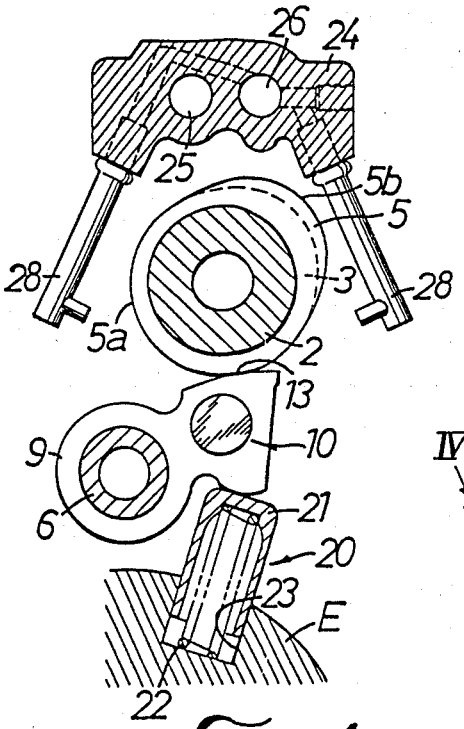
FIG. 1 is a vertical cross-sectional view of the valve operating mechanism of this invention taken substantially on the line I—I of FIG. 3.
Figure 2:
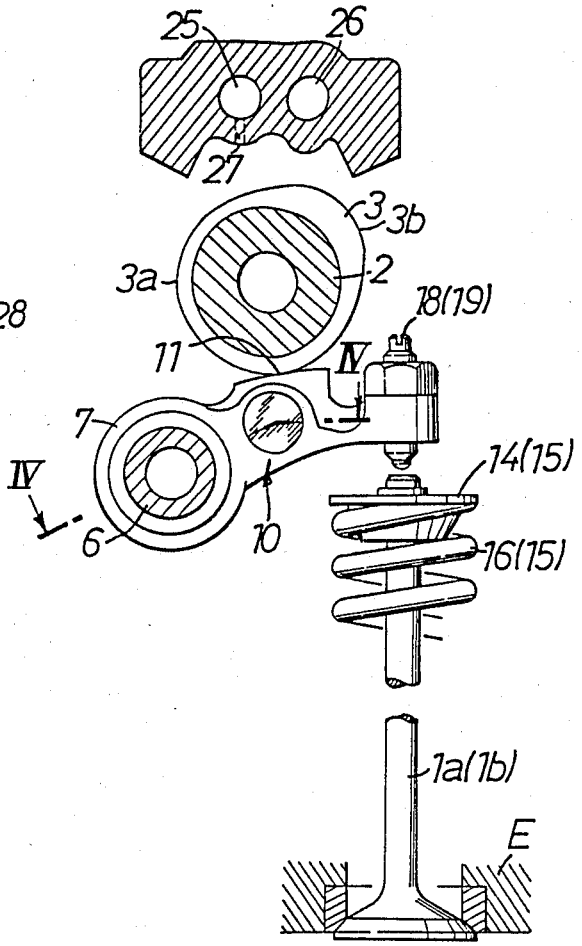
FIG. 2 is a vertical cross-sectional view taken substantially on the line II—II of FIG. 3.
Figure 3:
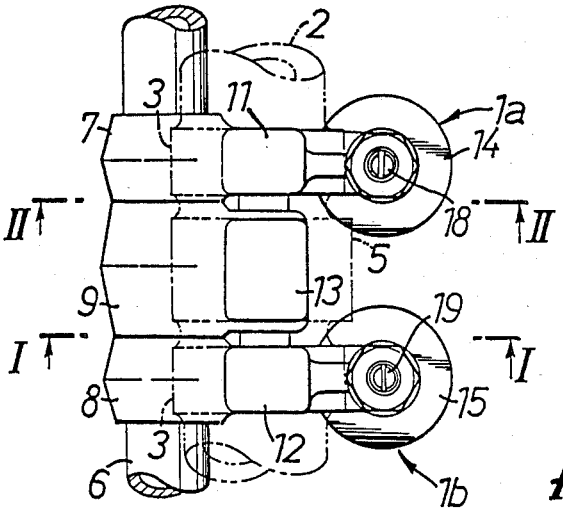
FIG. 3 is a plan view of the valve operating mechanism.

The invention will be described in connection with intake valves but it will be understood by those skilled in the art that it is equally applicable to exhaust valves. As shown in FIGS. 1, 2 and 3, a pair of intake valves 1*a*, 1*b* disposed in an engine body E is opened and closed by two low-speed cams 3 and one high-speed cam 5 which are integrally formed on a camshaft 2 rotatable by the crankshaft (not shown) of the engine at a speed ratio of ½ the speed or rotation of the crankshaft, by first, second, and third rocker arms 7, 8, 9 pivotally supported on a rocker shaft 6 extending parallel to the camshaft 2. A selective coupling mechanism 10 is provided in the rocker arms 7 through 9 for selectively connecting and disconnecting the rocker arms.

The camshaft 2 is rotatably disposed above the engine body E. The two low-speed cams 3 are integrally formed with the camshaft 2 in alignment with the intake valves 1*a*, 1*b*, respectively. The high speed cam 5 is integrally formed with the camshaft 2 in an intermediate position between the low-speed cams 3. Each of the low-speed cams 3 has a cam profile suited for low-speed operation of the engine, including a base circle portion 3*a* and a cam lobe 3*b* projecting radially outwardly from the base circle portion 3*a*. The high-speed cam 5 has a cam profile suited for high-speed operation of the engine, including a base circle portion 5*a* and a cam lobe 5*b* projecting radially outwardly to a larger extent and having a larger angular extent than the cam lobe 3*b*.

The rocker shaft 6 is fixed below the camshaft 2. The first rocker arm 7 has on its upper surface a cam slipper 11 slidably held against one low-speed cam 3, the second rocker arm 8 has on its upper surface a cam slipper 12 slidably held against the other low-speed cam 3, and the third rocker arm 9 has on its upper surface a cam slipper 13 slidably held against the high-speed cams 3. Thus, the rocker arms function as cam followers are pivotally supported on the rocker shaft 6 in mutually adjacent relation to each other in the axial direction of the rocker shaft 6.

The intake valves 1*a*, 1*b* are operatively associated with the first and second rocker arms 7, 8, respectively. The intake valves 1*a*, 1*b* are normally urged in a closing direction, i.e., upwardly, by valve springs S disposed between the engine body E and flanges 17 attached to the upper ends of the intake valves 1*a*, 1*b*. Tappet screws 18, 19 are adjustably threaded in the distal ends of the first and second rocker arms 7, 8, respectively, and held against the upper ends of the intake valves 1*a*, 1*b*, respectively.

The third rocker arm 9 is normally urged resiliently in a direction to cause the cam slipper 13 to slidably contact the high-speed cam 5 by resilient urging means 20 disposed between the third rocker arm 9 and the engine body E. The resilient urging means 20 comprises a cylindrical bottomed lifter 21 with its closed end held against the lower surface of the third rocker arm 9, and a lifter spring 22 disposed between the lifter 21 and the engine body E. The lifter 21 is slidably fitted in a bottomed hole 23 defined in the engine body E.

Above the camshaft 2, there is disposed a passage-defining body 24 extending between cam holders (not shown) by which the camshaft 2 is rotatably supported. The passage-defining body 24 has a low-speed lubricating oil passage 25 and a high-speed lubricating oil passage 26 which ar defined therein independenty of and parallel to each other. The low-speed lubricating oil passage 25 communicates with ejector holes 27 defined in a lower portion of the passage defining body 24 at positions aligned with the sliding surfaces of the low-speed cams 3 and the cam slippers 11, 12. A pair of lubricating oil ejector pipes 28 is connected to the passage-defining body 24 in communication with the high-speed lubricating oil passage 26 for ejecting lubricating oil toward the sliding surfaces of the high-speed cam 5 and the cam slipper 13 on opposite sides of the camshaft 2.

Figure 4:
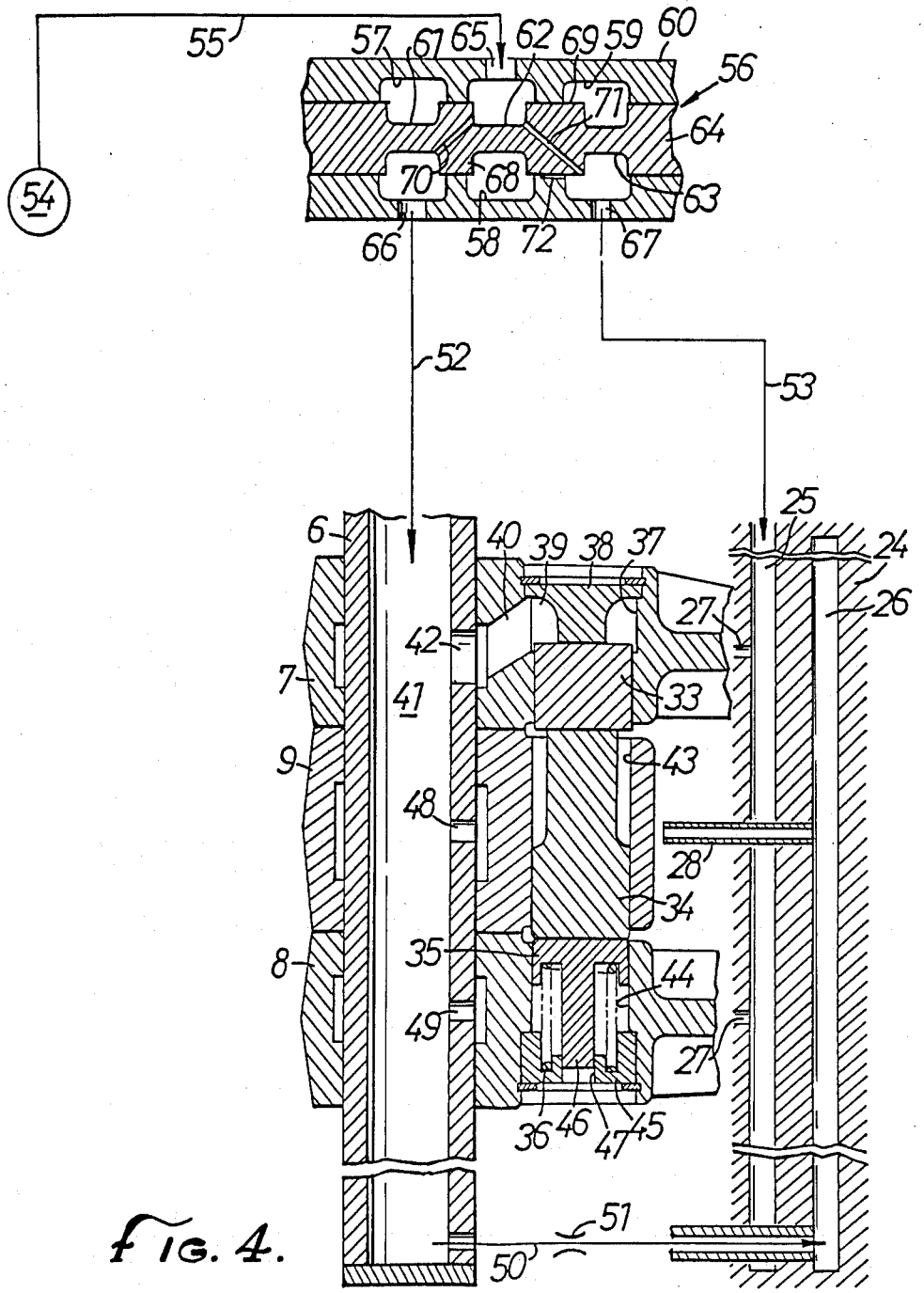
FIG. 4 is a cross-sectional view taken substantially on the line IV—IV of FIG. 2 and illustrating the selective coupling mechanism in the position for disconnecting the rocker arms.

As illustrated in FIG. 4, the selective coupling mechanism 10 comprises a first switching pin 33 capable of coupling the first and third rocker arms 7, 9 to each other, a second switching pin 34 capable of coupling the third and second rocker arms 9, 8 to each other, a third switching pin 35 for limiting movement of the first and second switching pins 33, 34, and a return spring 36 for urging the switching pins 33 through 35 in a direction to disconnect the rocker arms.

The first rocker arm 7 has a first guide hole 37 parallel to the rocker shaft 6 with an end closed by a closure member 38 remotely from the third rocker arm 9. The first switching pin 33 is slidably fitted in the first guide hole 37, with a hydraulic chamber 39 being defined between the closure member 38 and the first switching pin 33. The first rocker arm 7 also has an oil passage 40 defined therein in communication with the hydraulic chamber 39. The rocker shaft 6 has an oil pressure supply passage 41 defined therein. The oil passage 40 and the oil pressure supply passage 41 are in communication with each other at all times through a communication hole 42 defined in a side wall of the rocker shaft 65, irrespective of the angular position of the first rocker arm 7. The communication hole 42 also serves to supply lubricating oil between the rocker shaft 6 and the first rocker arm 7 from the oil pressure supply passage 41.

The third rocker arm 9 has a second guide hole 43 extending between its opposite surfaces parallel to the rocker shaft 6 in registration with the first guide hole 37 and the second guide hole 43 has the same diameter as the first guide hole 37. The second switching pin 34 has a length equal to the entire length of the second guide hole 43 and is slidably fitted therein.

The second rocker arm 8 has a third guide hole 44 extending parallel to the rocker shaft 6 in registration with the second guide hole 43 and the third guide hole 34 has the same diameter as that of the second guide hole 43. The end of the third guide hole 44 remote from the third rocker arm 9 is closed by a closure member 45. The third switching pin 35 is slidably fitted in the third guide hole 44 and has a smaller-diameter coaxial shaft 46 movably inserted through a guide hole 47 defined in the closure member 45. The return spring 36 is disposed around the shaft 46 between the closure member 45 and the third switching pin 35 for normally urging the abutting switching pins 33 through 35 in the direction to disconnect the rocker arms, i.e., toward the hydraulic chamber 39.

The side wall of the rocker shaft 6 has communication holes 48, 49 in radial alignment with the third and second rocker arms 9, 8. The communication holes 48, 49 supply lubricating oil between the rocker shaft 6 and the third and second rocker arms 9, 8 from the oil pressure supply passage 41.

With no high oil pressure supplied to the hydraulic chamber 39, the switching pins 33 through 35 are in the position where the rocker arms are disconnected under the bias of the return spring 36, as shown in FIG. 4. In this position, the abutting surfaces of the first and second switching pins 33, 34 lie between the first and third rocker arms 7, 9, and the abutting surfaces of the second and third switching pins 34, 35 lie between the third and second rocker arms 9, 8, with the rocker arms 7 through 9 being disconnected from each other. When high oil pressure is supplied to the hydraulic chamber 39, the switching pins 33 through 35 are moved in a direction away from the hydraulic chamber 39 against the force of the return spring 36 until the first switching pin 33 is slidably inserted into the second guide hole 43, and the second switching pin 34 is slidably inserted into the third guide hole 44 for thereby connecting the rocker arms 7 through 9.

The oil pressure supply passage 41 and the high-speed lubricating oil passage 26 communicate with each other through an oil passage 50 having a restriction 51 therein. Therefore, oil pressure supplied to the oil pressure supply passage 41 is restricted at its downstream end by the restriction 51 for insuring sufficiently high oil pressure to chamber 39 to operate the coupling mechanism 10 but the restriction 51 allows sufficient oil to be supplied to the high-speed lubricating oil passage 26 for accomplishing lubrication of the high speed cam 5.

A control valve 56 operable in response to a change in the operating conditions of the engine is connected between an oil passage 55 from an oil pressure supply source 54 and an oil passage 52 connected to the oil pressure supply passage 41 and an oil passage 53 connected to the low-speed lubricating oil passage 25.

The control valve 56 comprises a cylinder 60 having three axially spaced annular cavities 57, 58 and 59 defined in its inner surface and a plunger 64 slidably disposed in the cylinder 60 and having three axially spaced annular grooves 61, 62 and 63 in its outer surface. The cylinder 60 has an input port 65 communicating with the annular cavity 5 and with the oil pressure supply source 54 via an oil passage 55, an output port 66 communicating with the annular cavity 57 and the oil passage 52, and an output port 67 communicating with the annular cavity 59 and the oil passage 53.

Figure 5:
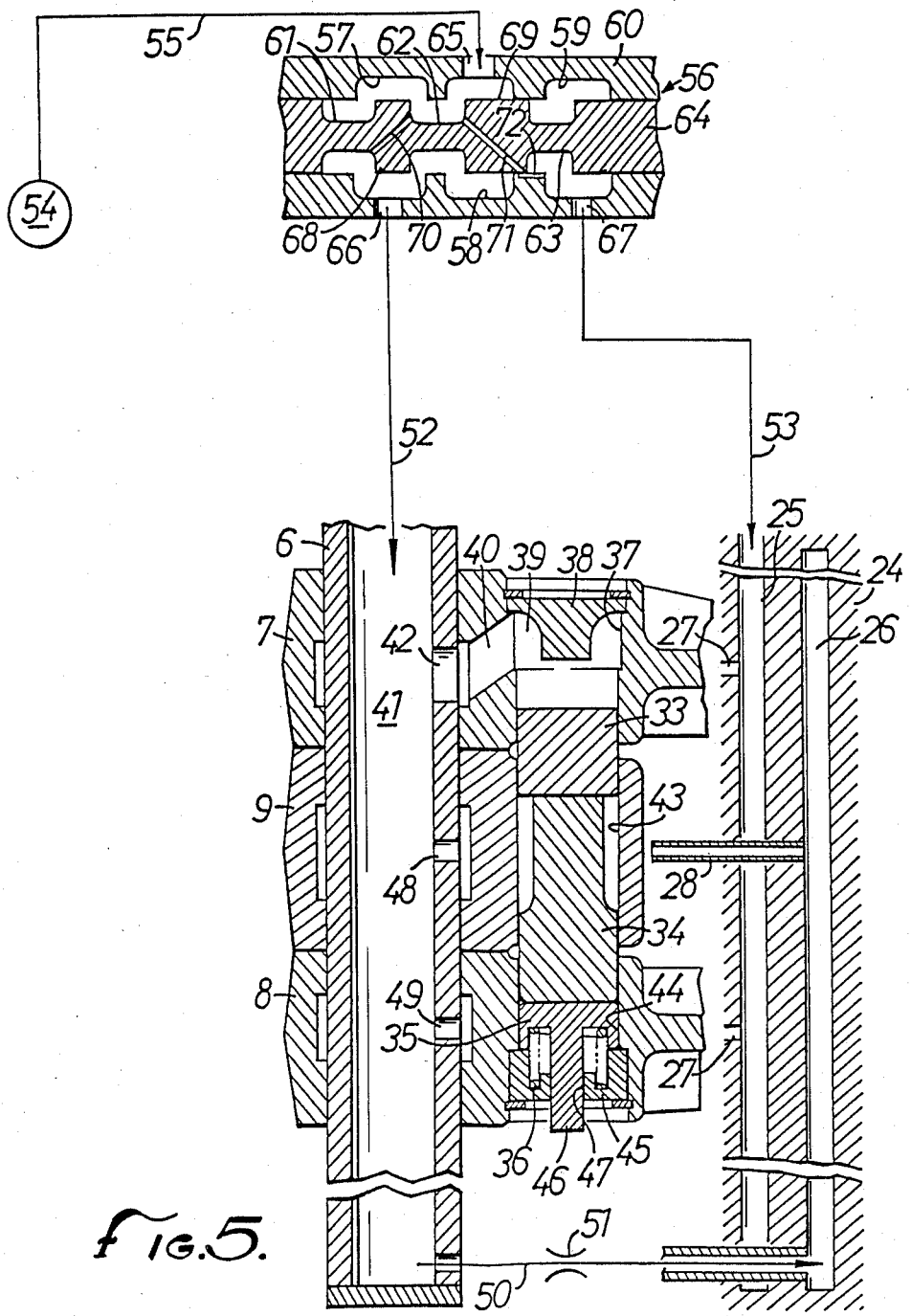
FIG. 5 is a cross-sectional view similar to FIG. 4 and illustrating the selective coupling mechanism in the position for interconnecting the rocker arms.

The plunger 64 is slidably movable by an actuator (not shown) in response to a change in the operating conditions of the engine. During low-speed operation of the engine, the plunger 64 is in the position shown in FIG. 4. For high-speed operation of the engine, the plunger 64 is moved to the left as shown in FIG. 5. During low-speed operation of the engine, a land 68 of the plunger 64 between the annular grooves 61 and 62 is held in slidable contact with the inner surface of the cylinder 60 between the annular cavities 57 and 58. During high-speed operation of the engine, the land 68 is positioned in the annular cavity 57 and spaced from the inner surface of the cylinder 60. A land 69 of the plunger 64 between the annular grooves 62 and 63 remains in slidable contact with the inner surface of the cylinder 60 between the annular cavities 58 and 59 at all times irrespective of the operating conditions of the engine. The land 68 has a restriction hole 70 defined therein and joining the annular grooves 61 and 62. The land 69 has a restriction hole 71 defined therein and having one end opening into the annular groove 62 and the other end opening at the outer peripheral surface of the land 69. When the engine operates in a low-speed range, the other end of the restriction hole 71 communicates with the annular cavity 59. When the engine operates in a high-speed range, the other end of the restriction hole 71 faces the inner surface of the cylinder 60. Preferably the inner surface of the cylinder 60 has a restriction recess 72 defined therein in a portion of the length between the annular cavities 58, 59 adjacent cavity 59 for communicating the other end of the restriction hole 71 with the annular cavity 59 in a restricted manner when the plunger 64 is positioned for high-speed operation of the engine to thereby supply a small amount of oil to the passage 25 and through the ejector holes 27 to the low-speed cams 3. However, if this small supply of oil to the low-speed cams 3 during high-speed operation is deemed unnecessary, such as because the over spray of oil from the high-speed cam 5 is adequate, the restriction recess 72 may be eliminated whereby the other end of hole 71 will be closed.

Operation of the valve operating mechanism thus constructed now will be described. During low-speed operation of the engine, the plunger 64 of the control valve 56 is positioned as shown in FIG. 4. In this position, the input port 65 and the output port 66 communicate with each other through the restriction hole 70. Therefore, oil pressure from the oil pressure supply source 54 is restricted and supplied to the oil pressure supply passage 41. The oil pressure from the oil pressure supply passage 41 is further restricted by the restriction 51 and supplied to the high-speed lubricating oi passage 26. The oil as thus restricted by the restriction hole 70 and restriction 51 is ejected in a small quantity from the lubricating oil ejector pipes 28. Since the oil pressure in the oil pressure supply passage 41, i.e., the hydraulic chamber 39 is relatively low, the switching pins 33 through 35 of the selective coupling mechanism 10 are maintained in the maximum stroke toward the hydraulic chamber 39 under the bias of the return spring 36. At this time, the abutting surfaces of the first and second switching pins 33, 34 lie between the first and third rocker arms 7, 9, and the abutting surfaces of the second and third switching pins 34, 35 lie between the third and second rocker arms 9, 8. Therefore, the rocker arms 7 through 9 are disconnected and angularly displaceable with respect to each other.

While the rocker arms 7 through 9 are being thus disconnected, the first and second rocker arms 7, 8 are angularly moved in sliding contact with the respective low-speed cams 3 in response to rotation of the camshaft 2. Therefore, the intake valves 1*a*, 1*b* are opened and closed at the timing and lift according to the profile of the low-speed cams 3. At this time, the third rocker arm 9 is angularly moved in sliding contact with the high-speed cam 5, but such angular movement does not affect operation of the first and second rocker arms 7, 8 in any way.

In the rocker arm disconnected position, the input port 65 and the output port 67 communicate with each other through the restriction hole 71, which restricts oil pressure from the oil pressure supply source 54 and supplies the restricted oil pressure into the low-speed lubricating oil passage 25. Therefore, a relatively small amount of lubricating oil is ejected from the ejector holes 27 toward the sliding surfaces of the low-speed cams 3 and the cam slippers 11, 12 which undergo a relatively large load during sliding movement. Simultaneously, a small amount of lubricating oil is ejected from the lubricating oil ejector pipes 28 toward the sliding surface of the high-speed cam 5 and the cam slipper 13, as described above. Therefore, the sliding surfaces of the high-speed cam 5 and the cam slipper 13 of the third rocker arm 9 which is biased upwardly by the resilient urging means 20 are sufficiently lubricated. As a result, the load on the valve operation mechanism during operation thereof can be reduced.

During high-speed operation of the engine, the plunger 64 of the control valve 56 is moved to the left as shown in FIG. 5. The annular cavities 57, 58 are brought into communication with each other through the annular groove 62. Therefore, a relatively high oil pressure is supplied into the oil pressure supply passage 41 and hence the hydraulic chamber 39. The switching pins 33 through 35 of the selective coupling mechanism 10 are moved into a position to connect the rocker arms against the spring bias of the return spring 36 for thereby inserting the first switching pin 33 slidably into the second guide hole 4 and inserting the second switching pin 34 slidably into the third guide hole 44. The rocker arms 7 through 9 are thus interconnected. At this time, since the third rocker arm 9 slidingly contacting the high-speed cam 5 swings to the maximum extent, the first and second rocker arms 7, 8 swing in unison with the third rocker arm 9, and hence the intake valves 1*a*, 1*b* are opened and closed at the timing and lift according to the profile of the high-speed cam 5.

When the selective coupling mechanism 10 is thus operated to connect the rocker arms, the sliding surfaces of the high-speed cam 5 and the cam slipper 13 are subjected to a larger load during sliding movement, and relatively low-pressure oil, as restricted by the restriction 51, is ejected from the lubricating oil ejector pipes 28 to these sliding surfaces. However, this low pressure oil supply to ejectors 28 is of a higher pressure and volume than the oil supplied to the ejectors 28 during low-speed operation when the oil supply is also restricted by the restriction hole 70. The low-speed lubricating oil passage 256 is supplied with oil pressure which is restricted by both the restriction hole 71 and the restriction recess 72 and therefore only a small amount of lubricating oil is ejected from the ejector holes 27. Since the load on the sliding surfaces of the low-speed cams 3 and the cam slippers 11, 12 as they slide against each other is small, no problem occurs even if the amount of lubricating oil supplied to these sliding surfaces is small or even cut-off completely if the restriction recess is eliminated as discussed above.

The rate of supply of lubricating oil to the low-speed lubricating oil passage 24 and the high-speed lubricating oil passage 25 is therefore controlled by the control valve 56 dependent on the operating conditions of the engine. Consequently, only the minimum amount of lubricating oil required needs to be supplied from the oil pressure supply source 54. The oil pressure supply source 54 may thrrefore be reduced in size, and hence the amount of energy consumed to drive the oil pressure supply source 54 may be reduced.

It should be noted that in certain embodiments of this general type of valve operating mechanism, at least one of the low-speed cams 3 may be replaced with a circular raised portion concentric with the camshaft 2 and the size of base circle portion 3*a* so that at least one of the intake valves 1*a* or 1*b* may be disabled or remain closed rest during low-speed operation of the engine. For purposes of this application, such a circular raised portion will also be referred to as a "cam" although it does not serve to move a valve.

With the present invention, as described above, the valve operating mechanism includes a low-speed lubricating oil passage for supplying lubricating oil to the sliding surfaces of a low-speed cam and a high-speed lubricating oil passage for supplying lubricating oil to the sliding surfaces of a high-speed cam and its cam follower, the low-speed and high-speed lubricating oil passages being provided independently of each other. Between the low-speed and high-speed lubricating oil passages and an oil pressure supply source, a control valve is provided for communicating the high-speed lubricating oil passage and the oil pressure supply source throughout the full operating range of the engine while restricting the rate of flow of oil during low-speed operation of the engine and for communicating the low-speed lubricating oil passage and the oil pressure supply source at least during low-speed operation of the engine. Therefore, the required amount of lubricating oils is supplied to the low-speed and high-speed lubricating oil passages dependent on the operating conditions of the engine. Thus, the amount of lubricating oil to be supplied can be reduced in its entirety, and the size of the oil pressure supply source and hence the amount of energy required to drive the oil pressure supply source can be reduced. The sliding surfaces of the high-speed cam and the associated cam follower which are held n slidable contact with each other in the full operating range of the engine are supplied with lubricating oil at all times, so that the load on the valve operating mechanism can be lowered.

We claim:

1. A valve operating mechanism for intake or exhaust valves of an internal combustion engine having a low-speed cam formed on a camshaft and suited for an operation mode of the intake or exhaust valves during low-speed operation of the engine, a high-speed cam formed on said camshaft and suited for an operation mode of the intake or exhaust valves during high-speed operation of the engine, a cam follower held in slidable contact with said low-speed cam, a cam follower held in slidable contact with said high-speed cam, a selective coupling mechanism disposed between said cam followers fo selectively connecting and disconnecting the cam followers in order to open and close the intake or exhaust valves dependent on the operating speed of the engine, an improvement comprising, a low-speed lubricating oil passage for supplying lubricating oil to sliding surfaces of the low-speed cam and the associated cam follower, a high-speed lubricating oil passage for supplying lubricating oil to sliding surfaces of the high-speed cam and the associate cam follower, said low-speed lubricating oil passage and said high-speed lubricating oil passage being separate of each other, an oil supply source, and a control valve connected between said oil supply source and said low-speed lubricating oil passage and said high-speed lubricating oil passage, said control valve being selectively operable for communicating said high-speed lubricating oil passage and said oil pressure supply source throughout a full operating range of the engine while restricting the rate of flow of oil during low-speed operation of the engine and for communicating said low-speed lubricating oil passage and said oil pressure supply source at least during low-speed operation of the engine.

2. A valve operating mechanism according to claim 1, wherein said control valve is provided with means for providing a restricted rate of oil flow between said low-speed lubricating oil passage and said oil pressure supply source during high-speed operation of the engine.

3. A valve operating mechanism according to claim 1, wherein said selective coupling mechanism is operable by oil pressure from an oil supply passage connected to said control valve, and said high-speed lubricating oil passage is connected to said oil supply passage.

4. A valve operating mechanism according to claim 2, wherein said selective coupling mechanism is operable by oil pressure from an oil supply passage connected to said control valve, and said high-speed lubricating oil passage is connected to said oil supply passage.

5. A valve operating mechanism according to claim 3, wherein a restriction means is provided between said oil supply passage and said high-speed lubricating oil passage.

6. A valve operating mechanism according to claim 4, wherein a restriction means is provided between said oil supply passage and said high-speed lubricating oil passage.

7. A valve operating mechanism for an internal combustion engine having means for selectively operating intake or exhaust valves by separate high-speed or low-speed cams, comprising, an oil supply source, a first passage for supplying oil from said source to the high-speed cam, a second passage for supplying oil from said source to the low-speed cam, and control means for selectively restricting the supply of oil from said oil supply source to at least one of said first and second passages when the cam to which that passage provides oil is not operating the intake or exhaust valves.

* * * * *